US005452820A

United States Patent [19]

Mislavsky

[11] Patent Number: 5,452,820

[45] Date of Patent: Sep. 26, 1995

[54] HINGED LID FOR BUCKET

[75] Inventor: Claude Mislavsky, Atascadero, Calif.

[73] Assignee: Lids West, Paso Robles, Calif.

[21] Appl. No.: 265,911

[22] Filed: Jun. 27, 1994

[51] Int. Cl.[6] ..... B65D 43/24

[52] U.S. Cl. ..... 220/335; 220/339

[58] Field of Search ..... 220/335, 339, 220/712, 308; 206/508

[56] References Cited

U.S. PATENT DOCUMENTS

| | | | |
|---|---|---|---|
| 3,417,897 | 12/1968 | Johnson | 220/339 |
| 3,421,654 | 1/1989 | Hexel | 220/339 |
| 4,460,103 | 7/1984 | Rama et al. | 220/712 |
| 4,609,768 | 8/1986 | Taber et al. | 215/237 |
| 4,717,018 | 1/1988 | Sacherer et al. | 220/335 |
| 4,785,931 | 11/1988 | Weir et al. | 206/508 |

*Primary Examiner*—Allan N. Shoap
*Assistant Examiner*—Robin A. Hylton
*Attorney, Agent, or Firm*—Daniel C. McKown

[57] ABSTRACT

A snap-on plastic lid for a bucket includes a fixed portion engaged to a lip on the rim of the bucket and pivotally connected by a living hinge to a movable portion that can be moved from a closed position to an open position. A toggle mechanism couples the movable portion to the fixed portion in such a way that the movable portion will remain in either the open position or the closed position until a deliberate force is applied to overcome the detenting action of the toggle. The entire lid can be molded as a unitary article if desired. In one alternative embodiment a positive mechanical lock is provided to secure the movable portion of lid in the open position, and in another embodiment bosses that extend above the lid facilitate stacking of buckets on which the lid is used.

1 Claim, 3 Drawing Sheets

HINGED LID FOR BUCKET

BACKGROUND OF THE INVENTION

1. Field of the Invention

The present invention is in the field of containers and specifically relates to a plastic lid having a fixed portion that snaps onto the rim of a bucket, having a movable portion connected to the fixed portion by a living hinge, and having a toggle mechanism connecting the fixed portion and the movable portion for selectively maintaining the movable portion in either a closed position or an open position.

2. The Prior Art

In U.S. Pat. No. 3,421,654, issued Jan. 14, 1969, Hexel describes a plastic lid that snaps onto the rim of a bucket and that has a fixed portion and a movable portion connected by a living hinge. The movable portion can be snapped onto the rim to secure it in a closed position, but the article lacks means for maintaining the lid in the open position. Although the lid is adapted to permit stacking of buckets, this is achieved by providing a lip that extends upwardly from the lid all around its periphery.

In U.S. Pat. No. 4,955,513, issued Sep. 11, 1990, Bennett describes a plastic lid that includes a flap that is hinged to the body of the lid and that is movable between an open position and a closed position. There is no provision for maintaining the lid in an open position In U.S. Pat. No. Des. 309,109, issued Jul. 10, 1990, Allen shows a lid that snaps onto a container. The lid is not hinged.

In U.S. Pat. No. 4,724,979, issued Feb. 16, 1988, Cleevely et al. describe a reclosable, tamper-evident plastic lid for a container that provides a double seal for the container until opened and provides a single seal thereafter. An upper portion of the lid is hinged to a portion that extends around the rim.

The lids of all of the above patents suffer from a common disadvantage, namely, they all lack means for holding the lid in the open position. Instead of remaining fully open once they have been opened, the lids have a tendency to return part of the way to the closed position, thereby requiring the user to employ one hand to hold the lid in a fully opened position. Unfortunately, removing material from a bucket and transferring the material to a smaller container usually requires the use of both hands-one hand for the ladle and another to hold or steady the smaller container. Therefore, the transfer is made difficult because the lid must be held open.

The lid of the present invention overcomes this difficulty of prior art lids and simultaneously provides a number of attractive features.

SUMMARY OF THE INVENTION

It is an objective of the present invention to provide a bucket lid that can easily be secured to and removed from a bucket, and that includes a movable portion attached to a fixed portion and coupled to the fixed portion in such a way that the movable portion will remain in a fully open position after it has been opened and will remain in a fully closed position once it has been closed.

This objective is achieved by the unique structure of the lid which includes tabs on the fixed portion that snap over the lip of the bucket to secure the fixed portion to the bucket, a living hinge connecting the movable portion to the fixed portion, and a toggle mechanism coupling the movable portion of the lid to the fixed portion of the lid.

In an alternative embodiment, the lid is provided with bosses that permit buckets to be stacked with their lids in the closed position.

In yet another embodiment, the entire lid can be molded as a unitary article.

The lid of the present invention was developed for use in the restaurant industry, in which certain foods such as salad dressing, baked beans, soups, pasta and gravy are prepared in large batches at a convenient time and are then stored in plastic 5-gallon buckets in a walk-in cooler or refrigerator. Later when there is a need for such a food, a worker opens the lid of the bucket and ladles a quantity of the stored food into a smaller container. Typically, there is no convenient place to set the small container, so it is held in one hand and the ladle is held in the other hand. Thus, no extra hand is available to hold the lid of the bucket open. When simple one-piece lids were used, the worker typically removed the lid completely prior to the transfer operation, and frequently the worker did not replace the lid, thereby leaving the food in the container exposed to the air and to contamination. It thus became clear that a need existed for a lid that could be moved from a fully-closed position to a fully-open position and vice versa with minimum time and effort on the part of the worker.

Although originally developed for use in the restaurant industry, it was quickly recognized that the desirable properties of the lid of the present invention would be quite useful in other industries as well, so that the present invention is not limited to the restaurant field.

The novel features which are believed to be characteristic of the invention, both as to structure and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 1:
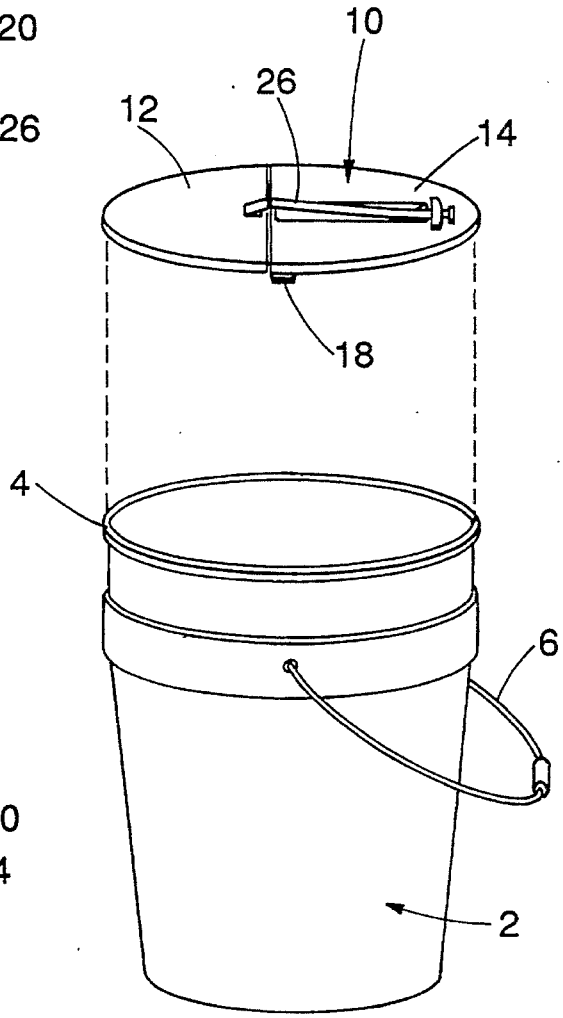
FIG. 1 is a perspective view showing a preferred embodiment of the lid of the present invention and showing the bucket with which the lid is used.
Figure 9:
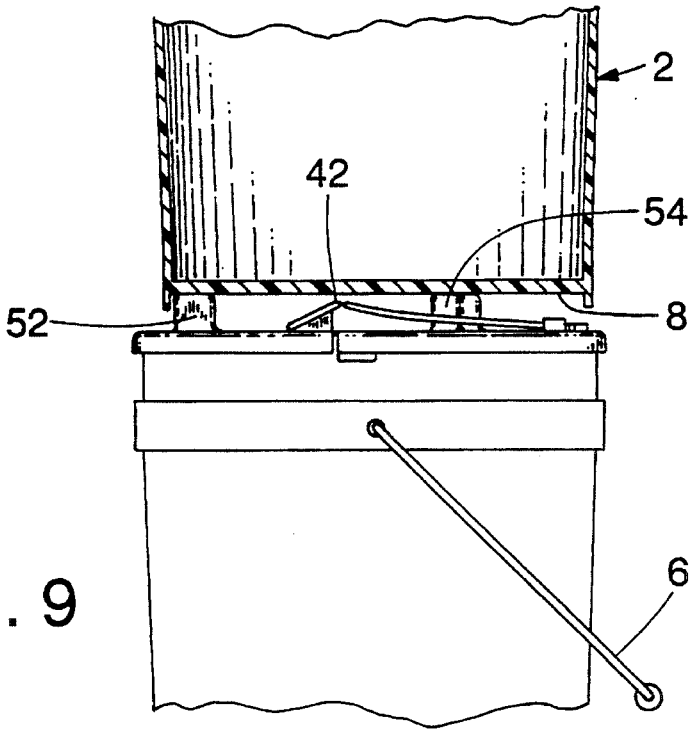

As indicated in FIG. 1, the lid 10 of the present invention is designed for use on a widely-used type of plastic 5-gallon bucket having an outwardly projecting lip 4 at its upper rim, and a bottom 8 of FIG. 9 that is recessed approximately 0.25 inch from the lower rim of the bucket. The bucket 2 is usually supplied with a bail 6.

Figure 2:
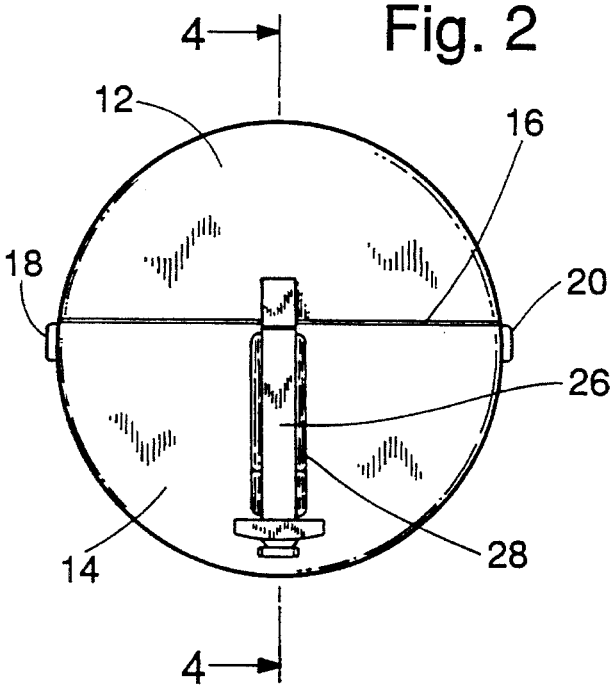
FIG. 2 is a top plane view of the preferred embodiment of the lid of the present invention.

As seen in FIG. 1, the lid 10 of the present invention serves as a cover for the bucket 2. The lid 10 includes a movable portion 12 and a fixed portion 14 that are joined by an integral living hinge 16. A top plan view of the lid 10 is shown in FIG. 2, while FIG. 3 is a bottom plan view of the lid.

Tabs 18 and 20, located on opposite sides of the fixed portion 14 of the lid snap under and engage the lip 4 of the bucket to secure the fixed portion 14 of the lid to the bucket 2. The movable portion 12 of the lid may be opened at will, but the fixed portion 14 always remains in contact with the upper rim of the bucket. The tabs 18 and 20 are deliberately kept short in the radial direction so as not to interfere with the bail 6 of the bucket when the bail is raised to the carrying position.

In an alternative embodiment, a third tab is provided at the front-most part of the movable portion 12 of the lid for applications where a more positive seal is required.

Figure 3:
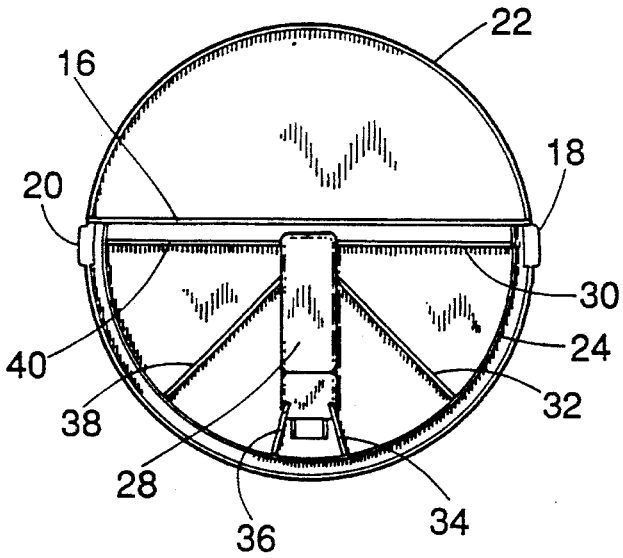
FIG. 3 is a bottom plane view of the preferred embodiment of the lid of the present invention.

As best seen in FIG. 3, both the movable portion 12 and the fixed portion 14 of the lid include a lip 22 that extends downwardly from the periphery of the lid. This lip 22 does not re-enter under the lip 4 of the bucket, but otherwise conforms closely to the shape of the upper rim of the bucket. In this way, the lip 22 does not impede opening or closing of the movable portion 12 or removal of the fixed portion 14 from the bucket.

Rearward motion of the fixed portion 14 in a horizontal direction is prevented by a second lip 24 that extends downwardly into the bucket from the fixed portion 14 of the lid. The lips 22 and 24 extend downwardly on the outside and inside respectively of the rim of the bucket. Together, the lips 22 and 24 provide an inverted U-shaped cross section that conforms closely to the shape of the upper rim of the bucket. FIG. 2 shows a tab 26 that is depressed by the user into a recessed area 28 to open the movable portion 12 of the lid. The tab 26 and the recessed area 28 may also be seen in FIGS. 4 and 5.

FIG. 3 also shows reinforcing ribs 30, 32, 34, 36, 38, and 40 as well as the under side of the recessed area 28.

Figure 5:
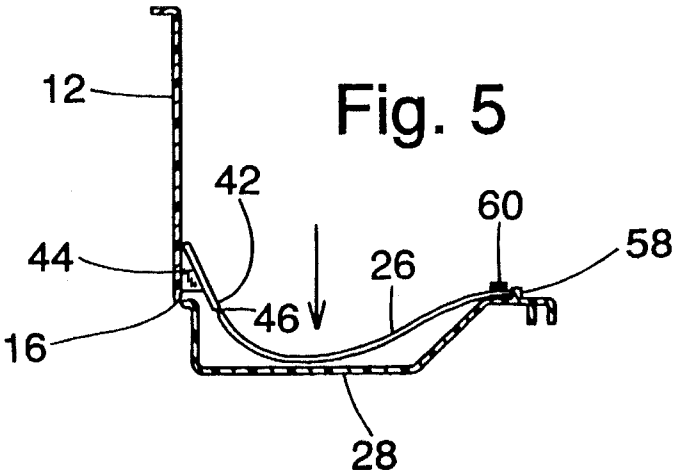
FIG. 5 is a side elevational view in cross section showing the lid of FIG. 4 in its open position.
Figure 4:
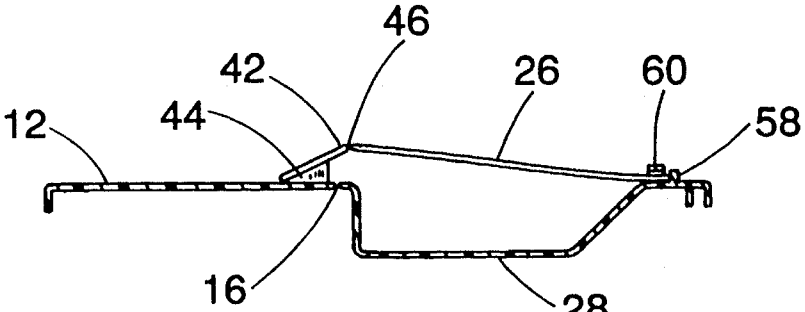
FIG. 4 is a side elevational view in cross section viewed in the direction 4—4 indicated in FIG. 2 and showing the lid in its closed configuration.

FIGS. 4 and 5 show the lid 10 in its closed and open configurations respectively. In the closed configuration of FIG. 4, the stiffness of the tab 26 maintains the movable portion 12 in its normal closed position. However, when the tab 26 is pressed downward by the user, as indicated by the arrow in FIG. 5, the tip 42 of the boss 44 is drawn downwardly, pivoting the movable portion 12 about the living hinge 16 to an open position. A living hinge 46 connects the tip 42 of the boss 44 to the tab 26; the living hinge 46 serves to prevent elastic restoring forces in the tab 26 from acting to close the movable portion of the lid once the downward force is removed. It is an important aspect of the present invention that once the downward force is removed, the movable portion 12 of the lid remains in the open position of FIG. 5 until the user manually pivots the movable portion to the closed position of FIG. 4.

Together, the boss, its tip 42, the tab 26, and the boss 58 constitute a toggle mechanism in which the tab 26, because it is longer than the straight-line distance between the bosses 44 and 58, must bow either upwardly or downwardly. In order to cause the tab to switch from the upwardly-bowed configuration to the downwardly-bowed configuration, the user must apply a force large enough to elastically deform the tab momentarily into a more complex shape and/or to force the tabs further apart momentarily. The design of such mechanisms is well-known in the art and needs no further explanation here.

Figure 7:
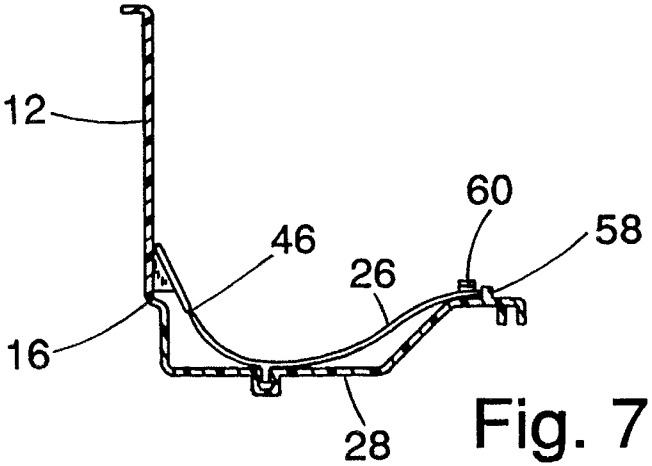
FIG. 7 is a side elevational view in cross section showing the alternative embodiment of FIG. 6 in its open position.
Figure 6:
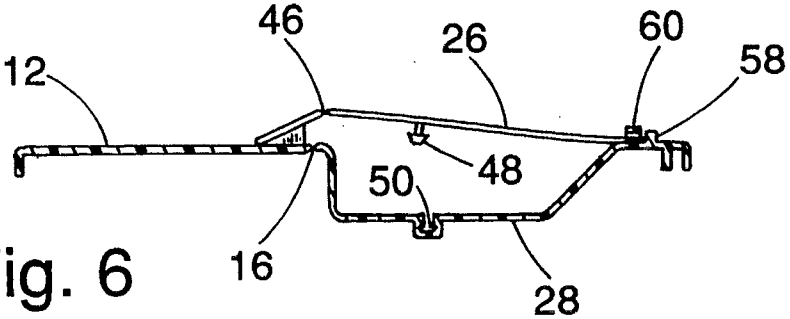
FIG. 6 is a side elevational view in cross section showing an alternative embodiment of the lid in its closed configuration.

FIGS. 6 and 7 show an alternative embodiment of the lid in a closed and an open position respectively. The alternative embodiment of FIGS. 6 and 7 is used in situations where it is desired to secure the movable portion 12 in an open position in a more positive manner than can be achieved in the embodiments of FIGS. 4 and 5. To bring about this result, a plug 48 is provided on the underside of the tab 26 and a socket 50 is provided in the recessed area 28. At the end of the downward movement of the tab 26, the plug 48 enters and becomes removably retained by the socket 50. A deliberate force must then be applied to the movable portion 12 to disengage the plug 48 from the socket 50 in order to close the movable portion 12.

In accordance with the present invention, regardless of whether the embodiment of FIGS. 4 and 5 or the embodiment of FIGS. 6 and 7 is used, once the movable portion 12 of the lid has been raised to its open position, the movable portion 12 remains open until the user pushes it shut. This frees the user's hands to remove material stored in the bucket 2 and to transfer that material to a different receptacle. The embodiment of FIGS. 6 and 7 might be preferred in applications where the bucket is tilted to pour a liquid, such as paint, from the bucket. In such an application, the weight of the movable portion 12 acts in a direction that tends to urge the movable portion closed, which might interfere with the stream being poured and therefore in such applications, the more positive locking arrangement of the embodiment of FIGS. 6 and 7 may be preferred.

In the preferred embodiment, the fixed portion 14 is provided with a buckle 60 immediately in front of the boss 58, and the tab 26 is molded as a flat, unbowed, portion. Thereafter, the tab 26 is manually bowed and the free end of the tab 26 is inserted into the space between the buckle 60 and the fixed portion 14 where it is retained by the elastic restoring force in the tab, which urges the tab to assume its original flat configuration thereby increasing the distance between the ends of the tab. This design makes it possible to manufacture the entire lid 10 as a unitary (one piece) article by injection molding.

Figure 8:
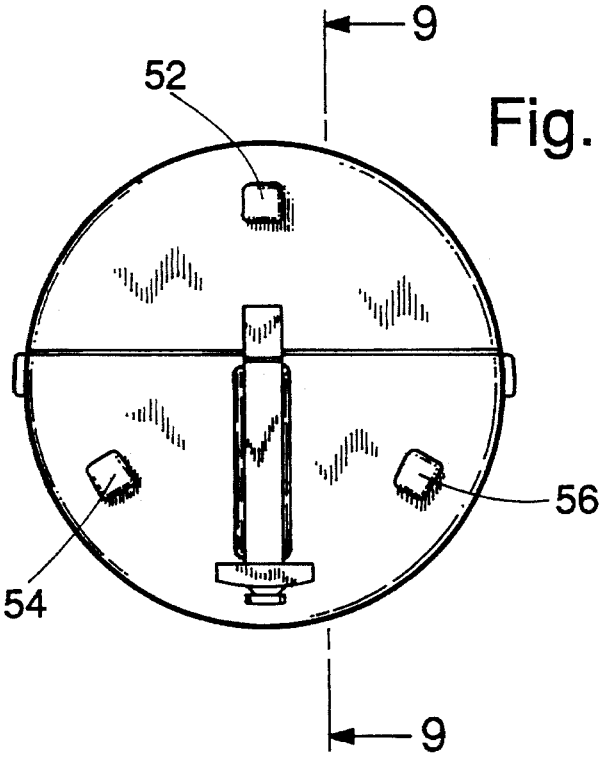
FIG. 8 is a top plane view of a second alternative embodiment of the lid of the present invention; and, FIG. 9 is a side elevational view partly in cross section showing how the lid of FIG. 8 facilitates stacking of the buckets.

FIGS. 8 and 9 show another alternative embodiment of the present invention. This alternative embodiment is particularly useful in situations where it is desired to stack one bucket upon another.

As best seen in FIG. 9, the bottom 8 of the bucket 2 is recessed approximately 0.25 inch from the lower rim of the bucket. Unfortunately, this amount of recess is not sufficient to clear the boss 44 and the tip 42. If the full weight of the upper bucket and its contents were to bear downward on those parts, it is likely that over a period of time the lid might deform and its operation might become less dependable.

To prevent this from happening, the lid of the alternative embodiment of FIGS. 8 and 9 is provided with three bosses 52, 54, and 56 that are tall enough to prevent the bottom 8 of the upper bucket from contacting the tip 42 and that are located radially outward from the center of the lid as far as the lower rim of the bucket will permit, thereby providing maximum stability to the stacked bucket. Also, location of the bosses 52, 54, and 56 radially outward as far as possible transmits the weight of the stacked bucket more directly to the rim of the lower bucket, thereby reducing deformation of the lid.

Thus, there has been described a useful lid for use with a widely used type of 5-gallon plastic bucket. The lid consists of a fixed portion 14 that remains closed and a movable portion 12 that can be quickly and easily moved from the closed position to an open position which is maintained until the user again closes the movable portion. Various embodiments of the lid have been described, and they permit the lid to be locked in the open position and permit the lid to be used in situations where buckets are stacked. All of these embodiments are considered to be within the scope of the present invention, but other embodiments not fully described herein will be suggested by the above description. These additional embodiments are also considered to be within the scope of the present invention which is limited only by the claims that follow.

What is claimed is:

1. A lid for a bucket having a lip that extends outwardly from the rim of the bucket, comprising in combination:

a fixed portion;

means on said fixed portion for engaging the lip of the bucket so as to hold said fixed portion in contact with the rim of the bucket;

a movable portion;

a living hinge pivotally connecting said fixed portion to said movable portion for motion of said movable portion between a closed position and an open position; and, toggle means coupling said fixed portion and said movable portion for maintaining said movable portion in the open position with respect to said fixed portion until, through application of a first applied force, said movable portion is brought to the closed position where it is maintained by said toggle means in the closed position until, through application of a second applied force, said movable portion is returned to the open position;

said toggle means further including a first boss affixed to said movable portion, a second boss affixed to said fixed portion, and a tab having a length greater than the distance between said first boss and said second boss, said tab having a first end connected to-said first boss and having a second end fastened to said second boss;

said toggle means further including a plug and a socket for securing said movable portion in the open position.

* * * * *